US005800186A

United States Patent [19]

Ramirez et al.

[11] Patent Number: 5,800,186

[45] Date of Patent: Sep. 1, 1998

[54] PRINTED CIRCUIT BOARD ASSEMBLY

[75] Inventors: Fernando J. Ramirez, Fountain Valley, Calif.; Brian A. Mahar; Philip J. Burdo, both of Huntington, Conn.

[73] Assignee: Framatome Connectors USA, Inc., Fairfield, Conn.

[21] Appl. No.: 816,091

[22] Filed: Mar. 13, 1997

[51] Int. Cl.[6] ..... H01R 9/09

[52] U.S. Cl. ..... 439/74

[58] Field of Search ..... 439/59, 65, 74, 439/637, 61, 327, 328

[56] References Cited

U.S. PATENT DOCUMENTS

| | | | |
|---|---|---|---|
| 3,731,252 | 5/1973 | McKeown et al. | 439/59 |
| 3,993,383 | 11/1976 | Marino | 439/848 |
| 4,018,495 | 4/1977 | Freitag | 439/55 |
| 4,232,924 | 11/1980 | Kline et al. | 439/74 |
| 4,981,438 | 1/1991 | Bekhiet | 439/76.1 |
| 5,259,767 | 11/1993 | Kurbikoff et al. | 439/59 |
| 5,308,249 | 5/1994 | Renn et al. | 439/62 |
| 5,389,000 | 2/1995 | DiViesti et al. | 439/328 |

*Primary Examiner*—Gary F. Paumen
*Assistant Examiner*—Barry M. L. Standig
*Attorney, Agent, or Firm*—Perman & Green, LLP

[57] ABSTRACT

A printed circuit board assembly which comprises a plurality of primary printed circuit boards, a plurality of card edge connectors, at least one secondary printed circuit board and means for predictable separation of the boards from each other. Each of the card edge connectors is fixedly mounted to a respective primary printed circuit board. The secondary printed circuit board is directly removably connected between two card edge connectors. The secondary printed circuit board has an aperture at an edge which is inserted into a card edge connector. The aperture is contacted by a spring element in the card edge connector providing the means for predictable separation of the boards from each other.

16 Claims, 3 Drawing Sheets

PRINTED CIRCUIT BOARD ASSEMBLY

BACKGROUND OF THE INVENTION

1. Field of The Invention

The present invention relates to printed circuit boards and, more specifically, to means for predictable separation of a printed circuit board assembly comprising multiple printed circuit boards.

2. Prior Art

U.S. Pat. No. 5,308,249 discloses a force generating member in a connector with ends that project into holes in a printed circuit board to latch the board to the connector. U.S. Pat. No. 5,259,767 discloses conductors that project into holes in a printed circuit board. U.S. Pat. No. 3,731,252 shows a connector with male members that pass into eyelet holes in a circuit board. U.S. Pat. No. 3,993,383 discloses a connector having a contact with a dimple engaging a recess in a circuit board. U.S. Pat. No. 4,018,495 discloses a connector contact with a curved rider entering a hole in a circuit board.

SUMMARY OF THE INVENTION

In accordance with one embodiment of the present invention, a printed circuit board assembly is provided comprising a plurality of primary printed circuit boards, a plurality of card edge electrical connectors, at least one secondary printed circuit board and means for predictable separation of the boards from each other. The card edge electrical connectors are fixedly mounted to respective primary printed circuit boards. The secondary printed circuit board is directly removably connected between two of the card edge connectors. The means for predictable separation of the boards from each other comprises the secondary printed circuit board having an aperture at one edge which is inserted into a first one of the card edge connectors. The aperture is contacted by a spring element in the first card edge connector.

In accordance with another embodiment of the present invention, an electronic board assembly is provided comprising a first printed circuit board assembly, a second printed circuit board assembly and a third printed circuit board. The first circuit board assembly comprises a first printed circuit board and a first card edge connector fixedly mounted on the first printed circuit board. The second printed circuit board assembly comprises a second printed circuit board and a second card edge connector fixedly mounted on the second printed circuit board. The third printed circuit board is interconnected directly between the first and second card edge connectors. The third board has at least one recess proximate one edge that is inserted into a card edge receiving area of the first connector. A spring element of the first card edge connector is located in the recess of the third printed circuit board.

In accordance with one method of the present invention, a method of assembling printed circuit boards is provided. The method comprises the steps of providing a first printed circuit board assembly having a first printed circuit board and a first card edge connector fixedly mounted to it; providing a second printed circuit board assembly having a second printed circuit board and a second card edge connector fixedly mounted to it; and inserting a third printed circuit board in between the first and the second connectors. The third printed circuit board is inserted between the first and second connectors so that a locating surface proximate one edge of the third printed circuit board which is inserted into the first connector, matingly engages a spring element of the first connector. Upon separation of the first printed circuit board assembly from the second printed circuit board assembly, the third printed circuit board will stay located in the first connector and slide out of the second connector.

In accordance with yet another embodiment of the present invention, an electronic board assembly is provided comprising a card edge connector and a printed circuit board. The card edge connector has a housing with a plurality of high force spring contacts connected to the housing. The housing has a relatively small height of less than about 0.5 inch. The housing has a substantially flat top surface and a card edge receiving area extending into the housing from the top surface. A portion of the printed circuit board is located in the card edge receiving area. The card edge connector further comprises a retainer located in the housing below the top surface and in communication with the card edge receiving area. The printed circuit board has a hole or a series of holes in the portion located in the card edge receiving area. The retainer projects into the hole to retain the printed circuit board with the connector.

BRIEF DESCRIPTION OF DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
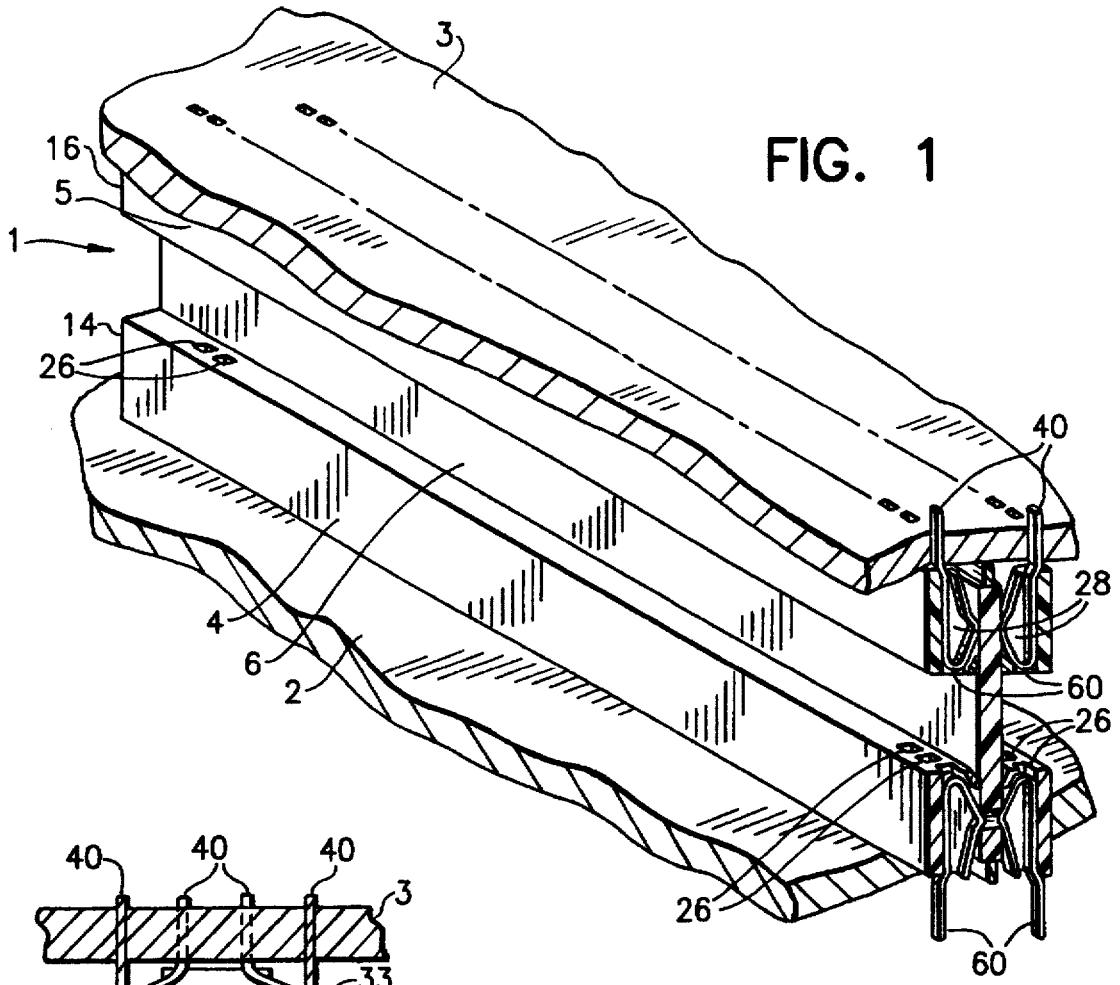
FIG. 1 is a partial perspective view with a cut away section of a printed circuit board assembly incorporating features of the present invention.

Referring to FIG. 1, there is shown a partial perspective view of an electronic board assembly 1 incorporating features of the present invention. Although the present invention will be described with reference to the single embodiment shown in the drawings, it should be understood that features of the present invention can be embodied in various different types of printed circuit board assemblies. In addition, any suitable size, shape or type of elements or materials could be used.

Figure 2:
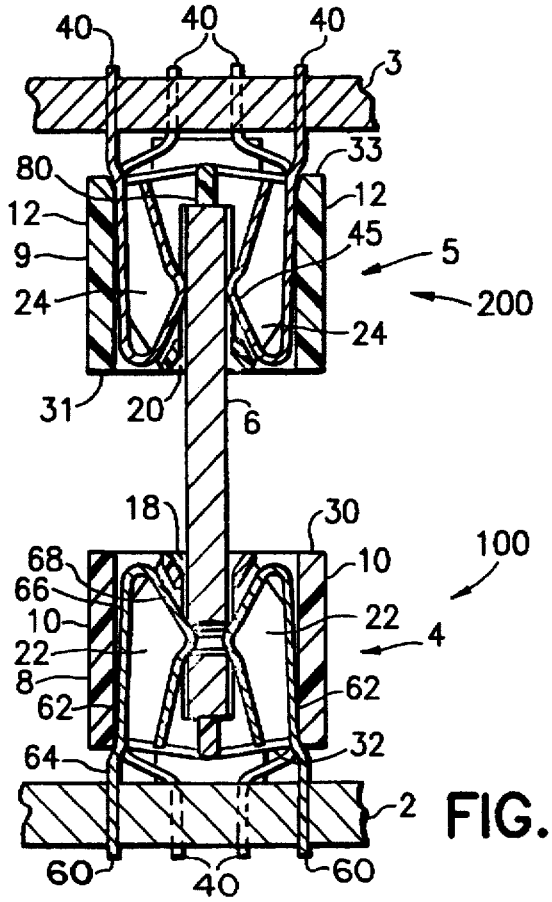
FIG. 2 is a cross-sectional view of the assembly shown in FIG. 1.

Referring also to FIG. 2, the electronic board assembly 1 generally comprises two printed circuit board assemblies 100, 200 and a secondary printed circuit board 6 connecting the two printed circuit board assemblies 100, 200. The first printed circuit board assembly 100 includes a first primary printed circuit board 2 and a first card edge connector 4 fixedly mounted to the first primary printed circuit board 2. The second printed circuit board assembly 200 includes a second primary printed circuit board 3 with a second card edge connector 5 fixedly mounted thereon. The secondary printed circuit board 6 is directly removably connected between the card edge connectors 4, 5 of the respective printed circuit board assemblies 100, 200.

Referring now to FIGS. 1–4, the card edge connector 4 generally comprises a housing 8, electrical spring contacts 40 and spring elements 60. The housing 8 is made of a dielectric material, such as a molded polymer or plastic material. The housing 8 has outer longitudinal walls 10 extending between two ends 14. The top surface 30 of the housing 8 is substantially flat. The housing 8 has a relatively small height of about 0.375 inch which provides a relatively low profile to the connector housing 8. A central card edge receiving area 18 extends into the housing 8 from the top surface 30. The card edge receiving area 18 is adapted to admit a portion of the secondary printed circuit board 6. Internal partitions 22 extend between the outer walls 10 of the housing 8 to form two rows of channels 26 on opposite sides of the card edge receiving area 18. The channels 26 extend from the top surface 30 to the bottom 32 of the housing 8, and communicate with the central card edge receiving area 18. Sections 34 at the top 30 of the housing 8 extend across each channel 26. The channels 26 are open at the bottom 32 of the housing 8. Preferably, an electrical contact 40 or a spring element 60 is housed in each channel 26.

The second card edge connector 5 is generally similar to the first card edge connector 4. The second card edge connector 5 comprises a housing 9 and electrical spring contacts 40. The housing 9 is made of a dielectric material. The height of the housing 9 is about 0.375 inch giving it the same relatively low profile as the first connector 4. Two longitudinal walls 12 connect the ends 16 of the housing 9. The top surface 31 is substantially flat. The housing 9 has a central card edge receiving area 20 extending thereinto from the top surface 31. The size of the card edge receiving area 20 is sufficient to admit part of the secondary printed circuit board 6. The housing 9 includes two rows of channels 28 on opposite sides of the card edge receiving area 20. The channels 28 are formed by internal partitions 24 extending between the outer walls 12 of the housing 9. The channels 28 extend between the top 31 to the bottom 33 of the housing 9 and are open to the card edge receiving area 20. Sections 35 extend across the top 31 of each channel 28. Each channel 28 is open at the bottom 33 of the housing 9. Preferably, each channel 28 contains an electrical contact 40.

In the preferred embodiment, the first connector 4 includes two pairs of opposing spring elements 60. In this connector 4, the spring elements 60 are housed in the channels 26 proximate the ends 14 of the respective housing 8. The remaining channels 26 of this connector 4 contain electrical contacts 40. In alternate embodiments, the number and placement of spring elements may be varied. For example, the number of spring elements may be increased, the spring elements may be located in intermediate channels as well as the end channels and on only one side of the card edge receiving area.

Figure 4:
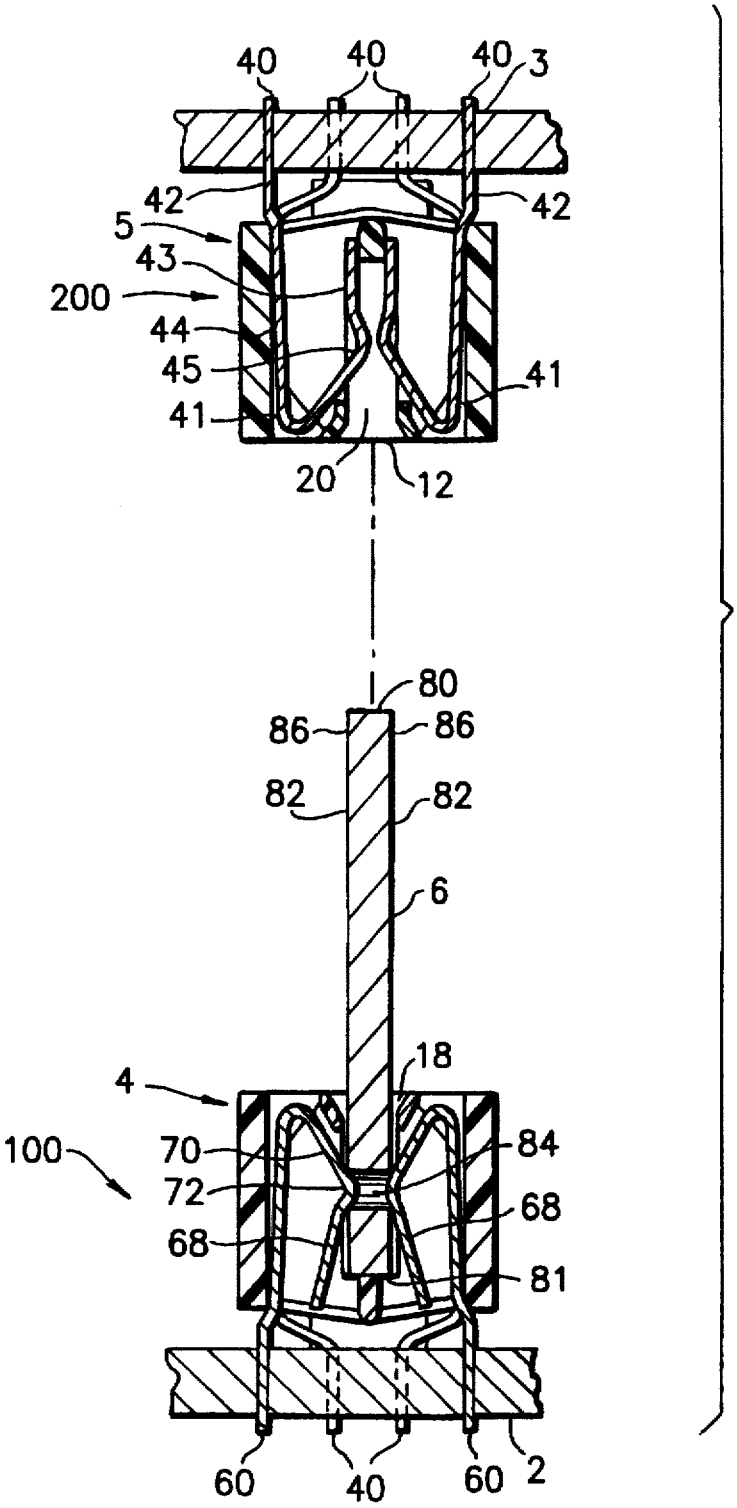
FIG. 4 is a cross-sectional view of the assembly shown in FIG. 1 with the upper printed circuit board assembly shown being removed from the lower printed circuit board assembly and the intermediate printed circuit board.

Referring to FIGS. 2 and 4, each spring element 60 is a one piece member made from sheet metal. The spring element 60 has an upper section 62 and a lower section 64. The upper section 62 is turned upon itself, forming an inverted general "U" shape. The lower section 64 has a single member extending from an outer leg 66 of the "U" shaped upper section 62. The upper sections 62 of the spring elements 60 are respectively received in corresponding channels 26 of the connector 4. The upper sections 62 remain below the top surface 30 of the housing 8. The lower sections 64 project from the bottom 32 of the housing 8. Within connector 4, the outer leg 66 of the inverted "U" upper section 62 on each spring element 60, is seated against an outer wall 10 of the housing 8. The inner leg 68 of each upper section 62 is resiliently deflectable. An upper ramp portion 70 on each inner leg 68 faces inwards and towards the top 30 of the housing 8. Rounded engagement surfaces 72 adjoin the lower end of the ramp portions 70. The ramp portions 70 and engagement surfaces 72 project into the card edge receiving area 18 of the connector 4. The lower sections 64 of the spring elements 60 are soldered to the primary printed circuit board 2 fixedly connecting the connector 4 to the primary printed circuit board 2. In the preferred embodiment, the lower sections 64 are through-hole mounted to the primary printed circuit board 2 as shown in FIG. 2. In an alternate embodiment, the lower section may extend generally parallel to the primary printed circuit board and be seated against connection pads on the primary printed circuit board.

In the preferred embodiment, the electrical contacts 40 are spring contacts substantially the same as the spring elements 60 as shown in FIG. 2. The electrical contacts 40 also comprise an upper section 41 and a lower section 42. The upper section 41 has an inverted general "U" shape with an inner leg 43 and an outer leg 44. The lower section 42 comprises a single member extending from the outer leg 44 of the upper section 41. The installation of the electrical contacts 40 within corresponding channels 26, 28 on each of the connectors 4, 5 is substantially similar to the installation of spring contacts 60 within respective channels 26 of connector 4. The upper section 41 of each electrical contact 40 is received in corresponding channels 26, 28 of the respective connectors 4, 5. The upper sections 41 of the contacts remain below the respective upper surfaces 30, 31 of each housing 8, 9. Ramp portions 45 on the inner leg 43 face inwards and to the respective top 30, 31 of each connector 4, 5. The ramp portions 45 on the electrical contacts 40 project into the respective card edge receiving areas 18, 20. The lower sections 42 of the contacts 40 project from the bottoms 32, 33 of each connector 4, 5. The lower sections 42 are soldered to the respective primary printed circuit boards 2, 3. Thus, connector 4 is fixedly attached to a primary printed circuit board 2 by the soldered connections of the lower section 64 of the spring contacts 60 and the lower sections 42 of the electrical contacts 40 within the connector 4. Connector 5, contains only electrical contacts 40 within and is fixedly attached to its mating primary printed circuit board 3 by the soldered connections of the lower sections 42 of the electrical contacts 40. In an alternate embodiment, connector 5 may also contain a combination of spring contacts and electrical contacts.

Figure 3:
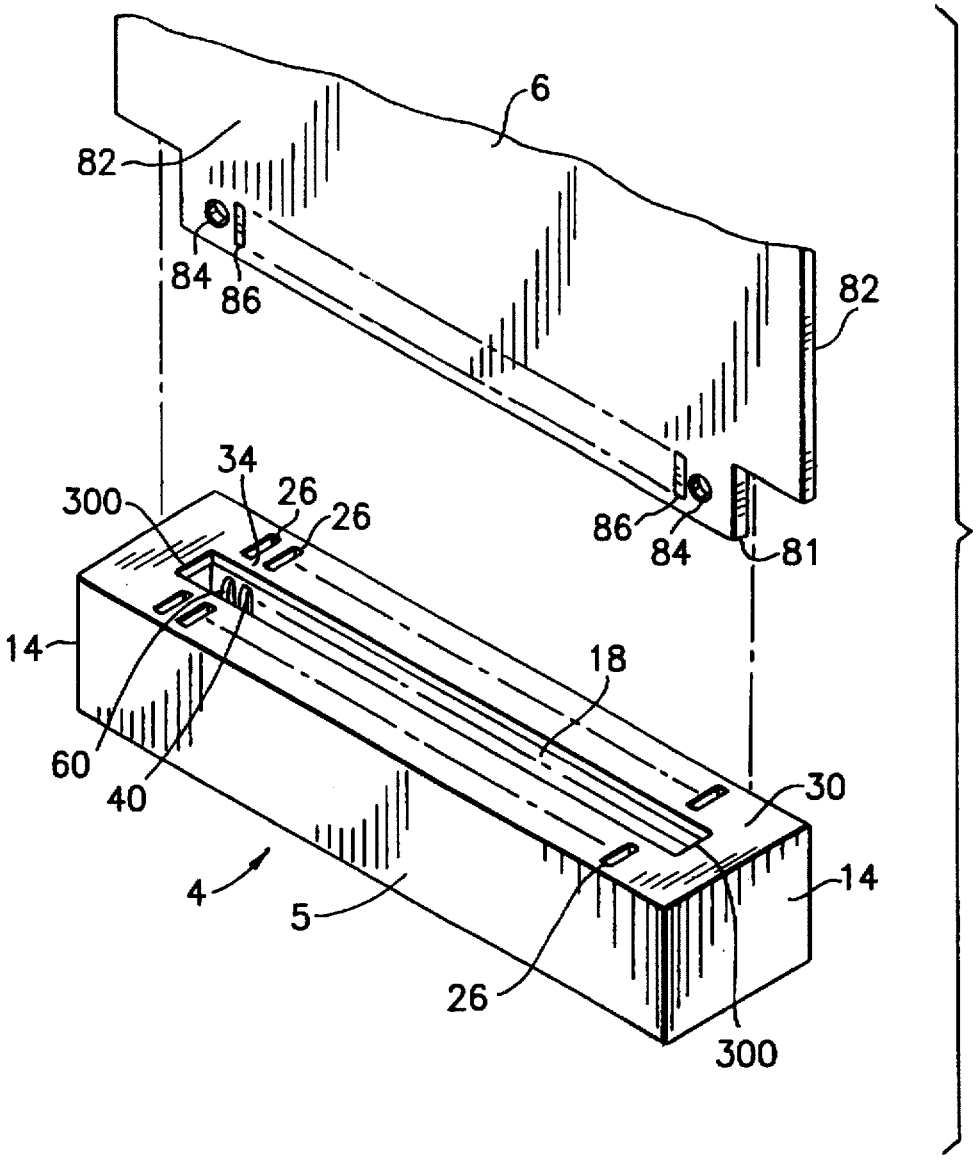
FIG. 3 is an exploded partial perspective view of one of the card edge connectors and the intermediate printed circuit board shown in FIG. 2.

Referring to FIGS. 3 and 4, the secondary printed circuit board 6 has an upper longitudinal edge 80, a lower longitudinal edge 81, and two longitudinal sides 82 therebetween. Contact pads 86 are placed along the longitudinal edges 80, 81 on both sides 82 of the secondary printed circuit board 6. The secondary printed circuit board 6 includes two or more through holes 84 proximate the lower edge 81. In an alternate embodiment, the two through holes may be located proximate the upper edge of the secondary printed circuit board. In another alternate embodiment, the secondary printed circuit board may have a blind recess in one side or both sides in lieu of each through hole. The through holes 84 are adapted to receive the engagement surfaces 72 on the inner legs 68 of the spring elements 60. The two through holes 84 are located to positionally align with channels 26 in the connector 4 containing spring elements 60.

The electronic board assembly 1 is formed by fixedly mounting each card edge connector 4, 5 to a respective primary printed circuit board 2, 3 to form the two printed circuit board assemblies 100, 200. The two printed circuit board assemblies 100, 200 are interconnected to each other by the secondary printed circuit board 6. To connect the printed board assemblies 100, 200, the lower edge 81 and upper edge 80 of the secondary printed circuit board 6 are inserted into the corresponding card edge receiving areas 18, 20 of the respective connectors 4, 5. During insertion, the ramp portions 45 on the electrical contacts 40 and the ramp portions 70 on the spring contacts 60, are contacted by the sides 82 of the secondary printed circuit board 6. Pressure exerted by the sides 82 of the secondary printed circuit board 6 on the ramp portions 70 resiliently deflect the inner legs 68 on the corresponding spring elements 60 in an outward direction. The pressure exerted by the board 6 on the ramp portions 45 also resiliently deflects the inner legs 43 of the electrical contacts 40 in an outward direction. Restoring forces in the deflected inner legs 43 on pairs of opposing electrical contacts 40 in each connector 4, 5 provide a clamping action against the sides 82 of the secondary printed circuit board 6. The clamping action between pairs of opposing electrical contacts 40 and the sides 82 of the secondary printed circuit board 6 creates a frictional connection between the secondary printed circuit board 6 and the connectors 4, 5 at the contact pads 86.

The ends 300 of the card edge receiving area 18 guide the entry of the secondary printed circuit board 6 into connector 4. Thus, the through holes 84 and contact pads 86 on the board 6 are aligned with corresponding spring elements 60 and spring contacts 40 in the connector 4. When the lower edge 81 of the secondary printed circuit board 6 is sufficiently inserted into the mating connector 4, the restoring forces in the deflected inner legs 68 deflect the engagement surfaces 72 on the pairs of opposing spring elements 60 into the through holes 84 as shown in FIG. 4. The engagement surfaces 72 protrude into the through holes 84 on both sides 82 of the secondary printed circuit board 6 mechanically restraining the board 6 to this connector 4. The engagement of the spring elements 60 into the through holes 84 on the secondary printed circuit board 6 creates high force contact. The spring contacts 40 in the first connector 4 also make a frictional high force contact with the pads 86 in the receiving area 18. Thus, mechanical retainment of the secondary board 6 with the connector 4 is provided by both the spring elements 60 projecting into the holes 84 and frictional engagement of the spring contacts 40 of the connector 4 on the pads 86 in the receiving area 18. However, mechanical retainment of the secondary board 6 with the connector 5 is provided only by frictional engagement of the spring contacts 40 of the connector 5 on the pads 86 in the receiving area 20.

Referring to FIGS. 2 and 4, when the electronic board assembly 1 is complete, the secondary printed circuit board 6 connects one printed circuit board assembly 100 to another printed circuit board assembly 200. During disassembly of the electronic board assembly 1, the secondary printed circuit board 6 predictably separates at from the printed circuit board assemblies 100, 200. The secondary printed circuit board 6 is frictionally connected at the upper edge 80 to the connector 5 as a result of the clamping action between pairs of opposing electrical contacts 40 and the sides 82 of the board 6. At the lower edge 81, in addition to frictional clamping action by the electrical contacts 40 at the receiving area 18, the secondary printed circuit board 6 is mechanically restrained to the connector 4 by the engagement of the pairs of opposing spring contacts 60 into the through holes 84 in the board 6. The withdrawal forces required to overcome the mechanical restraint between the secondary printed circuit board 6 and the first connector 4 are higher than the withdrawal forces sufficient to separate the friction connection between the board 6 and the second connector 5. When the electronic board assembly 1 is being disassembled, the differential between the forces required to overcome the connections predisposes the secondary printed circuit board 6 to remain within the connector 4 while the second assembly 200 is removed from the board 6. This differential in separation forces provides predictable separation of the printed circuit board assembly 200 from the secondary printed circuit board 6 before the other printed circuit board assembly 100 separates from the board 6. In a preferred embodiment, the spring elements 60 are identical to the spring contacts 40. This reduces manufacturing costs. In addition, because the spring elements 60 are located below the flat top surface 30 of the housing, the connector 4 can have a smaller height than prior art connectors with active retainer elements. The two connectors 4 and 5 could be identical to each other. Because only one end of the secondary board 6 has holes 84, predictable separation would still be provided. In an alternate embodiment, the spring elements 60 may also be used as an electrical ground for the secondary printed circuit board 6 to the first primary printed circuit board 2. In yet other alternate embodiments, multiple primary printed circuit boards may be assembled by inserting intermediate secondary printed circuit boards between them in a manner similar to that described above. There could also be multiple secondary printed circuit boards connected between the two primary printed circuit boards.

It should be understood that the foregoing description is only illustrative of the invention. Various alternatives and modifications can be devised by those skilled in the art without departing from the invention. Accordingly, the present invention is intended to embrace all such alternatives modifications and variances which fall within the scope of the appended claims.

What is claimed is:

1. A printed circuit board assembly comprising:

a plurality of primary printed circuit boards;

a plurality of card edge electrical connectors through hole fixedly mounted and soldered to the primary printed circuit boards;

at least one secondary printed circuit board readily connected between two of the card edge connectors on two respective primary printed circuit boards; and means for predictable separation of the boards from each other comprising the secondary printed circuit board having an aperture at only one edge that is inserted into a first one of the card edge connectors, the aperture being contacted by a spring element in the first card edge connector.

2. A printed circuit board assembly as in claim 1 wherein the spring element is a one-piece member.

3. A printed circuit board assembly as in claim 1, wherein the first card edge connector includes spring contacts and, the spring element is substantially the same as at least some of the spring contacts.

4. A printed circuit board assembly as in claim 1, wherein each card edge electrical connector comprises a dielectric housing with a central card edge receiving area.

5. A printed circuit board assembly as in claim 4 wherein the aperture in the secondary printed circuit board has a bore which is perpendicular to one side of the secondary printed circuit board, and which extends to the opposite side of the secondary printed circuit board.

6. A printed circuit board assembly as in claim 5 wherein the first card edge connector has two of the spring elements which are located on opposite sides of the card edge receiving area so that each aperture on each side of the secondary printed circuit board contacts the two spring elements.

7. A printed circuit board assembly as in claim 4 wherein the spring element comprises an upper section within the card edge electrical connector housing and a lower section extending from a bottom of the housing.

8. A printed circuit board assembly as in claim 7, wherein the upper section of the spring element has an inverted general "U" shape with an outer leg of the "U" being in contact with an outer wall of the card edge electrical connector housing and an inner leg of the "U" being resiliently deflectable.

9. A printed circuit board assembly as in claim 8 wherein the inner leg on the upper "U" section of the spring element has a ramp portion projecting into the central card edge receiving area so that the secondary printed circuit board contacts the ramp portion and deflects the inner leg when the secondary printed circuit board is inserted into the central card edge receiving area.

10. A printed circuit board assembly as in claim 1, wherein the spring element has engagement surfaces conforming to the apertures in the secondary printed circuit board, the engagement surfaces being located on the spring element so that the engagement surfaces are matingly received in one of the apertures of the secondary printed circuit board.

11. An electronic board assembly comprising:

a first printed circuit board assembly having a first printed circuit board and a first card edge connector through hole fixedly mounted and soldered on the first printed circuit board;

a second printed circuit board assembly having a second printed circuit board and a second card edge connector through hole fixedly mounted and soldered on the second printed circuit board; and a third printed circuit board interconnected readily and directly between the first and second card edge connectors, wherein the third board has at least one recess proximate one edge that is inserted into a card edge receiving area of the first connector and has a spring element of the first connector located therein.

12. An electronic board assembly as in claim 11, wherein the recess in the third printed circuit board extends between a first surface and a second surface of the third printed circuit board.

13. An electronic board assembly as in claim 11, wherein the spring element of the first connector has a lower section extending from a bottom of the first connector and an upper section with a resiliently deflectable arm extending from a base seated against a side of the first connector, the resiliently deflectable arm comprising a rider portion and a detent, the detent being inserted in the recess of the third printed circuit board when it is inserted in the first connector.

14. An electronic board assembly as in claim 11, wherein the first connector has a plurality of spring elements, the spring elements being located on opposite sides of the card edge receiving area.

15. An electronic board assembly as in claim 11, wherein the second card edge connector has a plurality of contacts that contact opposite spring surfaces of the third printed circuit board inserted into a card edge receiving area of the second connector.

16. A method of assembling printed circuit boards comprising the steps of:

providing a first printed circuit board assembly having a first printed circuit board and a first card edge connector through hole fixedly mounted and soldered to the first printed circuit board;

providing a second printed circuit board assembly having a second printed circuit board and a second card edge connector through hole fixedly mounted and soldered to the second printed circuit board; and inserting a third printed circuit board between the first and second connectors so that a locating surface proximate one edge of the third printed circuit board, which is inserted into the first connector, matingly engages a spring element of the first connector, wherein upon separation of the first printed circuit board assembly from the second printed circuit board assembly, the third printed circuit board will stay located in the first connector and slide out of the second connector.

* * * * *